US011152170B2

(12) United States Patent
Yoshihara

(10) Patent No.: US 11,152,170 B2
(45) Date of Patent: Oct. 19, 2021

(54) INPUT DEVICE

(71) Applicant: Panasonic Intellectual Property Management Co., Ltd., Osaka (JP)

(72) Inventor: Satoshi Yoshihara, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/637,707

(22) PCT Filed: Sep. 20, 2018

(86) PCT No.: PCT/JP2018/034719
§ 371 (c)(1),
(2) Date: Feb. 7, 2020

(87) PCT Pub. No.: WO2019/087608
PCT Pub. Date: May 9, 2019

(65) Prior Publication Data

US 2020/0176202 A1 Jun. 4, 2020

(30) Foreign Application Priority Data

Nov. 6, 2017 (JP) ..... JP2017-214083

(51) Int. Cl.
*H01H 25/00* (2006.01)
*H01H 25/06* (2006.01)

(52) U.S. Cl.
CPC ..... *H01H 25/002* (2013.01); *H01H 25/008* (2013.01); *H01H 25/06* (2013.01); *H01H 2025/004* (2013.01)

(58) Field of Classification Search
CPC .... H01H 2237/004; H01H 3/12; H01H 13/14; H01H 13/44; H01H 13/70; H01H 13/705;
(Continued)

(56) References Cited

U.S. PATENT DOCUMENTS 4,918,264 A * 4/1990 Yamamoto ..... H01H 15/10 200/16 R
5,619,021 A * 4/1997 Yamamoto ..... G05G 9/04796 200/6 A
(Continued)

FOREIGN PATENT DOCUMENTS

JP 2002-093278 3/2002
JP 2003-308759 10/2003
(Continued)

OTHER PUBLICATIONS

International Search Report of PCT application No. PCT/JP2018/034719 dated Nov. 13, 2018.
(Continued)

*Primary Examiner* — Ahmed M Saeed
(74) *Attorney, Agent, or Firm* — McDermott Will and Emery LLP

(57) ABSTRACT

An input device includes: an operation part being slidable in a first direction along a reference plane and in a second direction along the reference plane; and a slide detector detecting that the operation part slides. The slide detector includes a rocking body and a rocking motion detector, the rocking body is inclined with respect to the reference plane in accordance with a sliding movement of the operation part, and the rocking motion detector detects that the rocking body is inclined.

5 Claims, 9 Drawing Sheets

(58) Field of Classification Search
CPC ..... H01H 13/7065; H01H 21/22; H01H 2221/044; H01H 25/002; H01H 25/008; H01H 25/06; H01H 2025/004; H01H 25/00; H01H 89/00
See application file for complete search history.

(56) References Cited

U.S. PATENT DOCUMENTS

| | | | | |
|---|---|---|---|---|
| 6,455,795 | B1 * | 9/2002 | Murakami | H01H 13/14 200/345 |
| 6,593,909 | B1 * | 7/2003 | Chou | G05G 9/047 200/6 A |
| 6,831,238 | B1 | 12/2004 | Lau | |
| 2011/0083946 | A1 * | 4/2011 | Niiyama | H01H 25/002 200/160 |
| 2015/0185757 | A1 | 7/2015 | Jantke | |

FOREIGN PATENT DOCUMENTS

| | | |
|---|---|---|
| JP | 2011-086490 | 4/2011 |
| JP | 2011-100552 | 5/2011 |
| JP | 2012-064324 | 3/2012 |
| JP | 2014-116167 | 6/2014 |
| WO | 2009/062360 | 5/2009 |
| WO | 2009/116364 | 9/2009 |
| WO | 2014/006038 A1 | 1/2014 |

OTHER PUBLICATIONS

The Extended European Search Report dated Oct. 23, 2020 for the related European Application No. 18873809.0.

* cited by examiner

INPUT DEVICE

CROSS-REFERENCE TO RELATED APPLICATIONS

This application is a U.S. national stage application of the PCT International Application No. PCT/JP2018/034719 filed on Sep. 20, 2018, which claims the benefit of foreign priority of Japanese patent application No. 2017-214083 filed on Nov. 6, 2017, the contents all of which are incorporated herein by reference.

TECHNICAL FIELD

The present disclosure relates to an input device and, in more detail, an input device capable of rotational operation input and slide operation input.

BACKGROUND ART

There is conventionally disclosed a multidirectional operation switch (input device) in which a rotational operation and an operation by sliding (slide operation) are possible (see PTL 1, for example). In the multidirectional operation switch of PTL 1, a sliding case and a sliding body made of a wiring board are slidably housed in a fixed body. In addition, in the fixed body, a first movable body and a second movable body are mounted between the fixed body and the sliding body to be movable in mutually perpendicular directions. Between the fixed body and the sliding body, there are formed lever switches as first switch contacts. Between the sliding body and a rotary body, there are formed second switch contacts. A rocking operation of the sliding body causes electrical connection and disconnection of the first switch contacts. Rotation of the rotary body causes electrical connection and disconnection of the second switch contacts.

CITATION LIST

Patent Literature

PTL 1: Unexamined Japanese Patent Publication No. 2003-308759

SUMMARY OF THE INVENTION

An input device according to an aspect of the present disclosure includes: an operation part being slidable in a first direction along a reference plane and in a second direction along the reference plane; and a slide detector detecting that the operation part slides. The slide detector includes a rocking body and a rocking motion detector. The rocking body is inclined, with respect to the reference plane, in accordance with a sliding movement of the operation part, and the rocking motion detector detects that the rocking body is inclined.

The input device of the present disclosure provides an advantageous effect that downsizing can be achieved.

DESCRIPTION OF EMBODIMENT

An exemplary embodiment and modified examples described below are merely examples of the present disclosure, and the present disclosure is not limited to the exemplary embodiments or the modified examples. Besides the exemplary embodiment and the modified examples, various modifications are possible depending on design or the like without departing from the scope of the technical idea of the present disclosure.

(1) Outline

Figure 1:
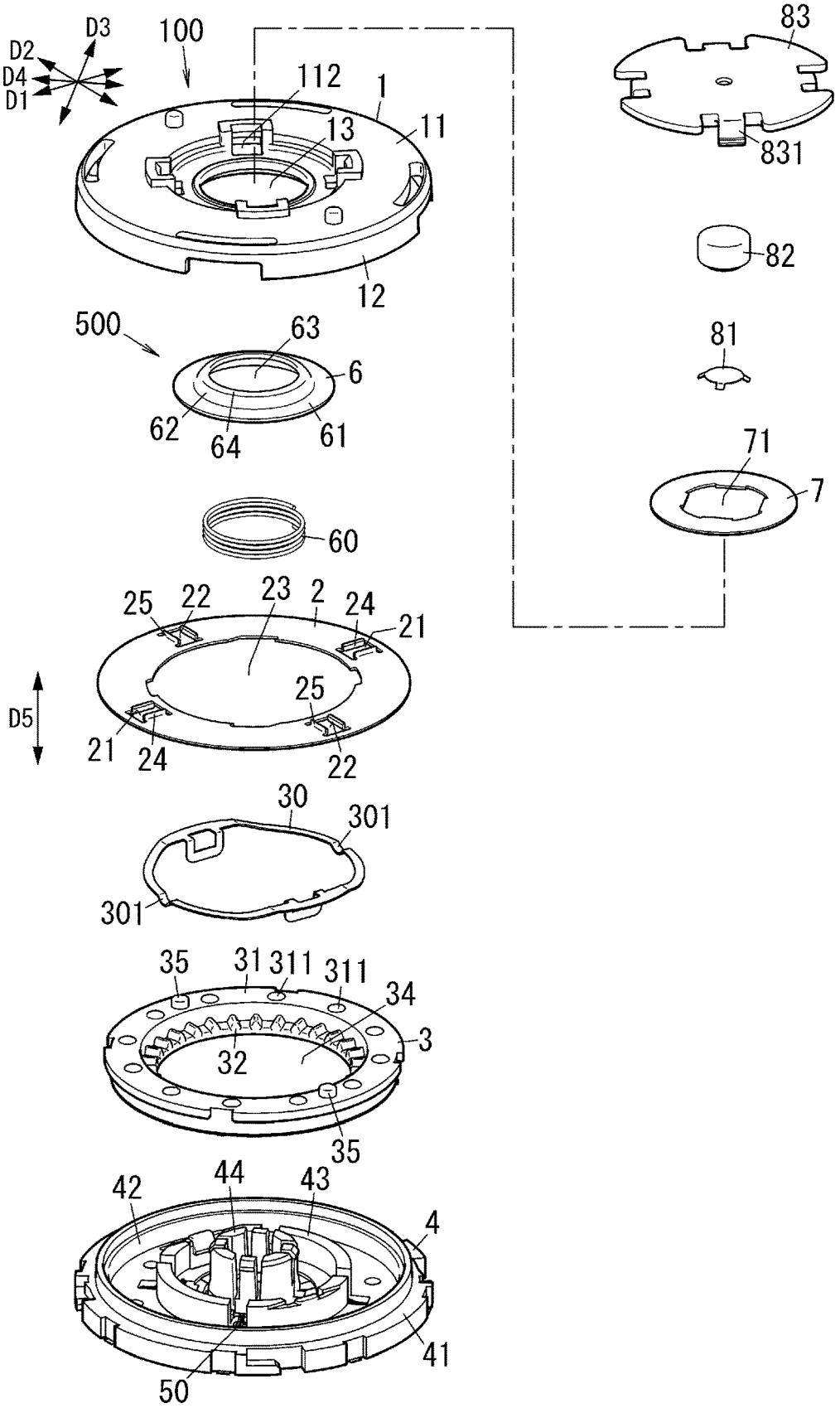
FIG. 1 is an exploded perspective view of an input device according to an exemplary embodiment of the present disclosure.

An exploded perspective view of input device 100 of the present exemplary embodiment is shown in FIG. 1. A plan view of input device 100 is shown in FIG. 2A, a front view is shown in FIG. 2B, and a lower surface view is shown in FIG. 2C.

Figure 2A:
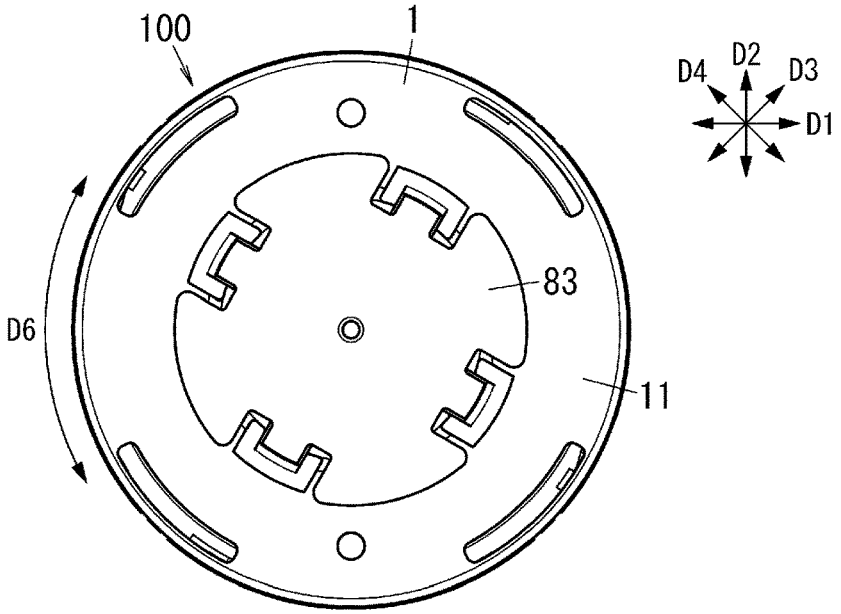
FIG. 2A is a plan view of the input device shown in FIG. 1.
Figure 2B:
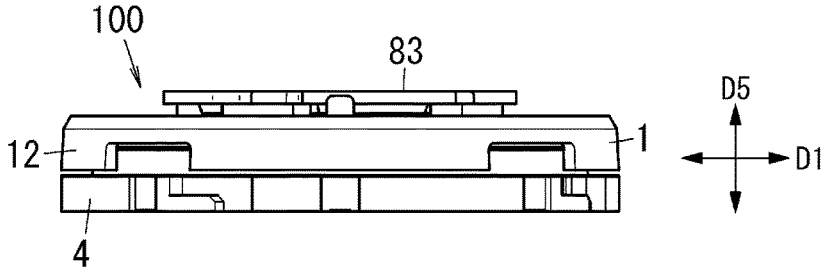
FIG. 2B is a front view of the input device shown in FIG. 1.
Figure 2C:
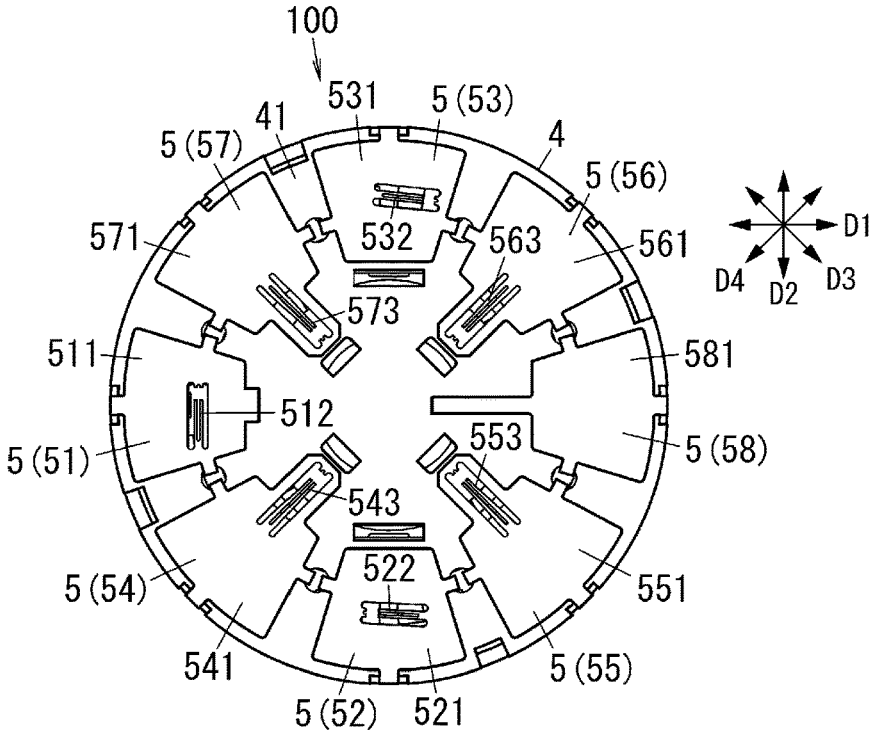
FIG. 2C is a lower surface view of the input device shown in FIG. 1.

In the following description, the horizontal direction in FIG. 2A is assumed as direction D1, and the vertical direction in FIG. 2A is assumed as direction D2. Direction D1 and direction D2 are perpendicular to each other. Further, oblique directions intersecting direction D1 and direction D2 are assumed as direction D3 and direction D4. Direction D3 and direction D4 are perpendicular to each other. Direction D3 is inclined with respect to direction D1 and direction D2 by 45°. Direction D4 is inclined with respect to direction D1 and direction D2 by 45°. Directions D1 to D4 are along the same plane, and the same plane is referred to as a reference plane. In addition, the vertical direction in FIG. 2B is assumed as direction D5. Direction D5 is perpendicular to the reference plane. Note that intersecting angles among directions D1 to D5 may be deviated from the right angle (90°) or 45° within a range of error.

Input device 100 of the present exemplary embodiment is a complex operation input device in which input can be performed by independently using each of rotational operation input, slide operation input, and push operation input. Input device 100 includes: operation part 1 that accepts rotational operation input and slide operation input from a user; pressing body 83 that accepts push operation input from a user; and base 4 holding operation part 1 and pressing body 83.

Operation part 1 is formed in an approximately circular shape in a plan view and is configured to be able to make a rotational movement with respect to base 4. A rotation axis of operation part 1 passes through a center of operation part 1 and is along direction D5. With reference to FIG. 2A, a rotation direction of operation part 1 is shown by D6.

Further, operation part 1 is configured to be able to make a sliding movement with respect to base 4 in the reference plane, along which directions D1 to D4 are. Operation part 1 can make a sliding movement in the reference plane in any direction of 360° centering a standard position. The standard position is a position where a center of operation part 1 and a center of base 4 overlap each other in direction D5. Input device 100 of the present exemplary embodiment is configured to detect each of eight sliding movements of operation part 1 along respective directions D1 to D4 centering the standard position.

Pressing body 83 is configured to be able to move in a direction along direction D5 with respect to base 4. When pressing body 83 accepts push operation input from a user, pressing body 83 moves in a direction approaching base 4 along direction D5. Input device 100 of the present exemplary embodiment is configured to detect a movement of pressing body 83 in the direction approaching base 4 along direction D5.

Figure 3:
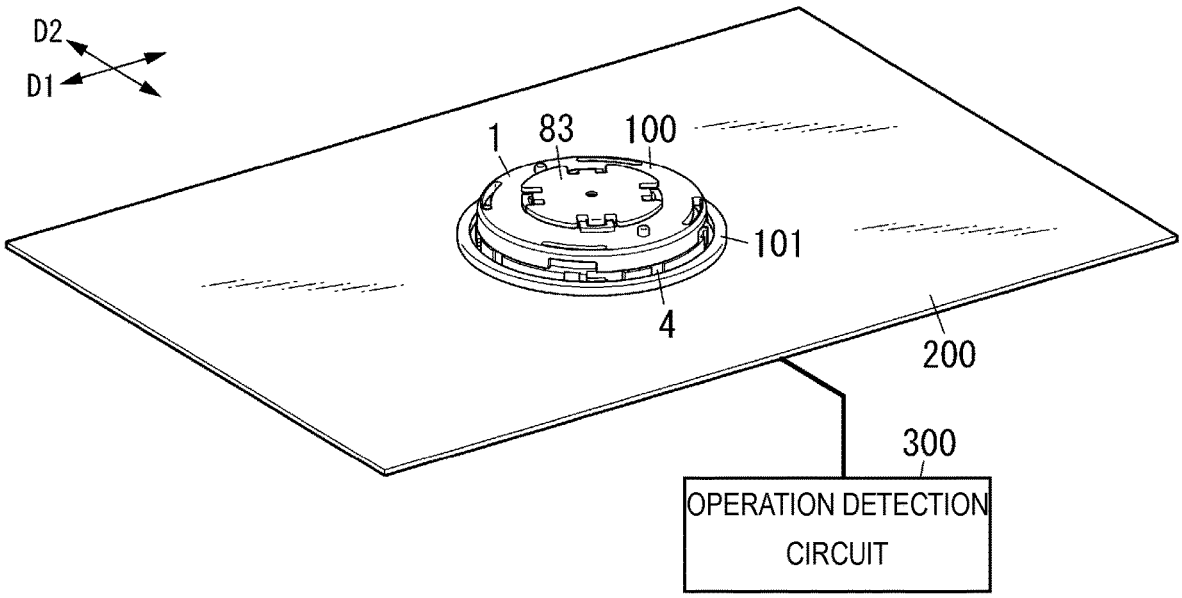
FIG. 3 is a perspective view when the input device shown in FIG. 1 is disposed on a touch panel.

As shown in FIG. 3, input device 100 of the present exemplary embodiment is disposed on capacitance type touch panel 200. Details will be described later, but input device 100 includes a plurality of fixed electrodes 5 (see FIG. 2C). Input device 100 is disposed such that the plurality of fixed electrodes 5 are opposed to a plurality of sensor electrodes held by touch panel 200. Input device 100 is positioned and fixed by circular ring-shaped holding member 101 provided on touch panel 200. Depending on rotational operation input, slide operation input, and push operation input performed on input device 100, an electrical state between fixed electrodes 5 of input device 100 and the respective sensor electrodes of touch panel 200 changes. The plurality of sensor electrodes are electrically connected to operation detection circuit 300. By detecting a change in capacitance generated between the plurality of fixed electrodes 5 and the respective sensor electrodes, operation detection circuit 300 detects the rotational operation input, the slide operation input, and the push operation input performed by a user on input device 100. Specifically, operation detection circuit 300 detects a rotation direction (orientation), a rotation angle, a rotational movement speed, and the like of operation part 1 by the rotational operation input. Further, operation detection circuit 300 detects a sliding movement of operation part 1, due to the slide operation input, in the eight directions along respective directions D1 to D4. Operation detection circuit 300 is configured with, for example, a microcomputer having a processor and a memory. In other words, operation detection circuit 300 is implemented by a computer system having a processor and a memory. Then, the processor executing an appropriate program causes the computer system to function as operation detection circuit 300. The program may be previously recorded in the memory or may be provided through an electric telecommunication line such as the Internet or provided being recorded in a non-transient recording medium such as a memory card.

(2) Configuration

In the following, a detailed configuration of input device 100 of the present exemplary embodiment will be described with reference to FIGS. 1 to 9.

In the following, a description will be made assuming, for the sake of convenience of description, direction D5 (see FIGS. 1 and 2B) is defined as the vertical direction, a side of operation part 1 with respect to base 4 is defined as the upper side, and a side of base 4 with respect to operation part 1 is defined as the lower side. Note that the expression "vertical direction" used in the following description does not limit the orientation of input device 100 when input device 100 is used. The terms used in the present disclosure to indicate directions merely represent a relative positional relationship.

As shown in FIG. 1, input device 100 of the present exemplary embodiment includes operation part 1, coupling body 2, rotary body 3, base 4, rocking body 6, return spring 60, click spring 30, and fixing member 7. Input device 100 further includes movable contact 81, elastic body 82, and pressing body 83.

Figure 4:
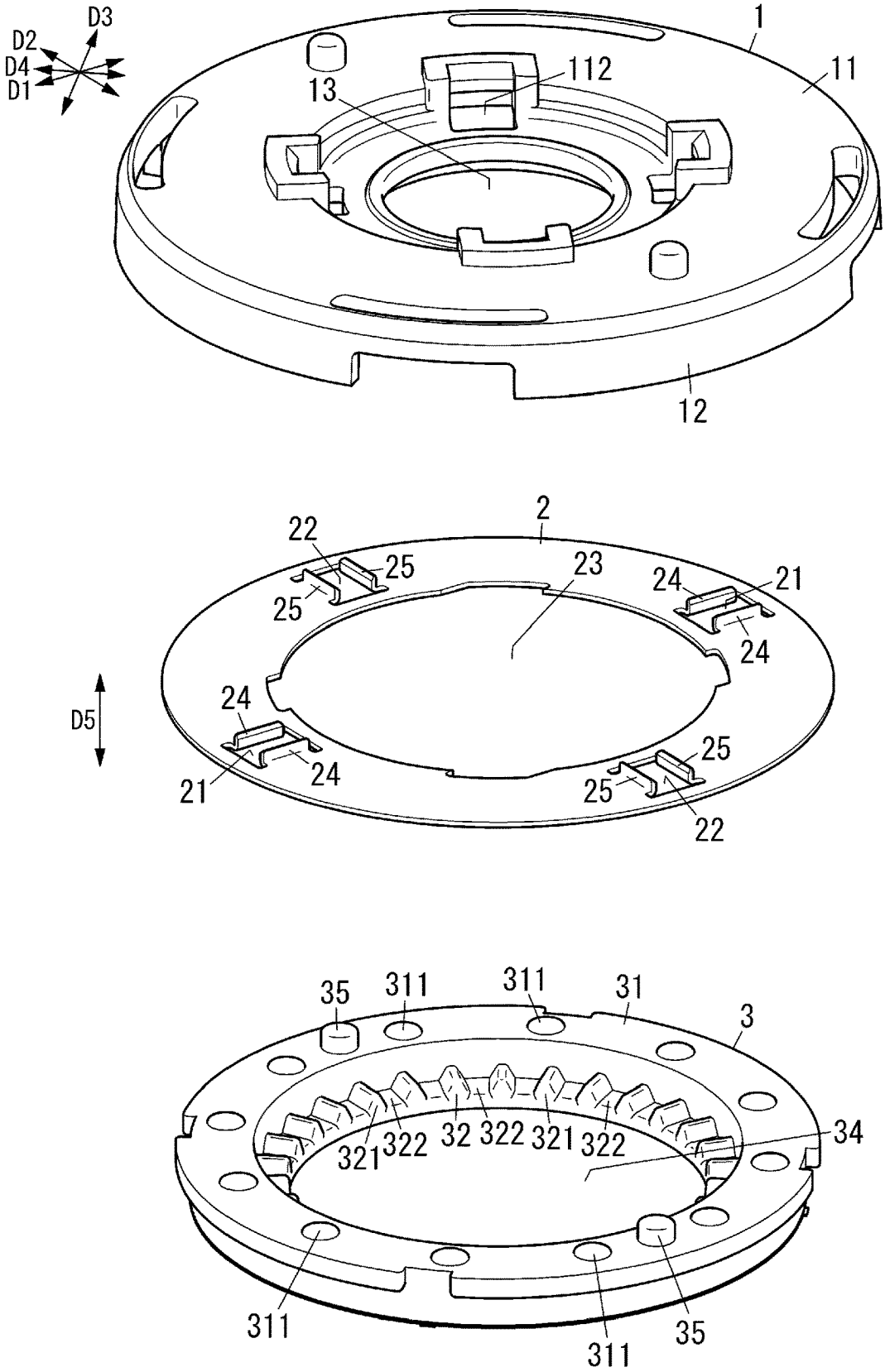
FIG. 4 is an exploded perspective view of an operation part, a coupling body, and a rotary body of the input device shown in FIG. 1.

First, configurations of operation part 1, coupling body 2, and rotary body 3 will be described with reference to FIGS. 4 and 5. Note that FIGS. 4 and 5 are each an exploded perspective view for illustrating a relationship among operation part 1, coupling body 2, and rotary body 3; and other components other than operation part 1, coupling body 2, and rotary body 3 of input device 100 are omitted.

Operation part 1 is configured with a resin having electric insulation properties or other material and accepts rotational operation input and slide operation input from a user. Operation part 1 has main body part 11 and peripheral wall 12. Main body part 11 is formed in a circular shape in a plan view. In a central part of main body part 11 in a plan view, there is formed circular through hole 13. Inner separation wall 44 of base 4 (see FIG. 1) is penetrated through through hole 13. Peripheral wall 12 is formed to protrude downward from an outer peripheral edge of main body part 11. This peripheral wall 12 creates storing space 17 surrounded by peripheral wall 12, on the lower surface side of main body part 11 (see FIG. 5). Storing space 17 is a space whose lower surface is open. This storing space 17 houses coupling body 2. Coupling body 2 is located in the space (storing space 17) surrounded by main body part 11 and peripheral wall 12.

Note that peripheral wall 12 does not necessarily have to protrude from the outer peripheral edge of main body part 11. For example, peripheral wall 12 may be formed slightly inside from the outer peripheral edge of main body part 11.

Figure 5:
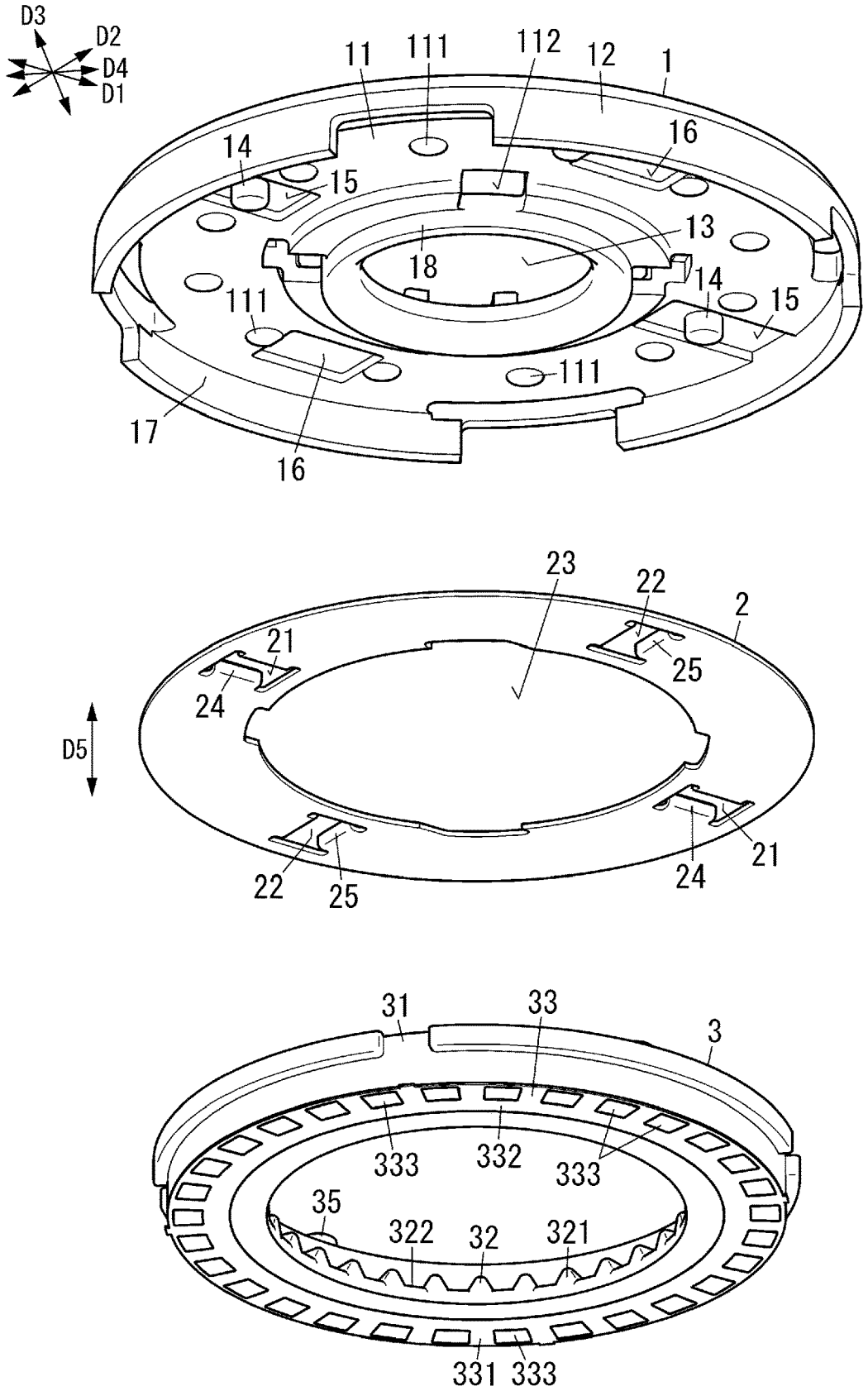
FIG. 5 is an exploded perspective view, viewed from a different direction, of the operation part, the coupling body, and the rotary body of the input device shown in FIG. 1.

As shown in FIG. 5, a pair of first projections 14 are formed on the lower surface of main body part 11. The pair of first projections 14 are formed on a straight line along direction D1 passing through a center of main body part 11 (through hole 13). The pair of first projections 14 are formed on one side and the other side in direction D1 with respect to the center of main body part 11 (through hole 13). First projections 14 are each formed in a cylindrical shape. The pair of first projections 14 penetrate through a pair of first openings 21 held by coupling body 2 disposed below operation part 1, respectively.

Further, main body part 11 has a pair of first recessed parts 15 formed in surrounding areas of the pair of first projections 14 on a lower surface of main body part 11 (see FIG. 5). In other words, the pair of first projections 14 are formed to protrude from a bottom surface of the pair of first recessed parts 15. First recessed parts 15 are each formed in an approximately rectangular shape whose longitudinal direction is aligned with direction D1. The pair of first recessed parts 15 are opposed in the vertical direction to a pair of first openings 21 held by coupling body 2 disposed below operation part 1, respectively. Inside each of the pair of first recessed parts 15, there are located first cut-and-raised pieces 24 formed on each of a periphery of the pair of first openings 21 in coupling body 2 (see FIG. 4).

Further, on the lower surface of main body part 11, there are formed a pair of second recessed parts 16 on a straight line along direction D2 passing through the center of main body part 11 (through hole 13) (see FIG. 5). The pair of second recessed parts 16 are formed on one side and the other side in direction D2 with respect to the center of main body part 11 (through hole 13). The pair of second recessed parts 16 are each formed in an approximately rectangular shape whose longitudinal direction is aligned with direction D1. The pair of second recessed parts 16 are opposed in the vertical direction to a pair of second openings 22 held by coupling body 2 disposed below operation part 1, respectively. Inside each of the pair of second recessed parts 16, there are located second cut-and-raised pieces 25 formed on a periphery of each of a pair of second openings 22 in coupling body 2 (see FIG. 4).

As shown in FIG. 5, on the lower surface of main body part 11, there are formed a plurality of first bosses 111 (12 bosses in the present exemplary embodiment). The plurality of first bosses 111 are formed approximately equidistantly in a circumferential direction with respect to the center of main body part 11 (through hole 13). Each of the plurality of first bosses 111 is formed in a columnar shape. First bosses 111 have a smaller protrusion dimension in direction D5 than first projections 14. Lower ends of first bosses 111 are located above lower ends of first projections 14. The plurality of first bosses 111 prevent or reduce contact between the lower surface of main body part 11 and an upper surface of coupling body 2. In other words, the plurality of first bosses 111 reduce a contact area between operation part 1 and coupling body 2. This arrangement reduces friction force between operation part 1 and coupling body 2 and thus makes it easy for operation part 1 to slidingly move.

In addition, there is outer rib 18 formed downward from a peripheral edge of through hole 13 in the lower surface of main body part 11. Outer rib 18 is formed in a ring shape. An inner peripheral surface of outer rib 18 is inclined such that a distance from the inner peripheral surface to the center of through hole 13 becomes smaller upward from its lower end part (see FIG. 8). Outer rib 18 comes into contact with rocking body 6 to be described later.

In addition, four through holes 112 are formed in a surrounding area of through hole 13 of main body part 11. Four through holes 112 are formed on straight lines along direction D3 and direction D4 passing through the center of main body part 11 (through hole 13). Four through holes 112 are formed on one side and the other side in direction D3 and on one side and the other side in direction D4 with respect to the center of main body part 11 (through hole 13). Through four through holes 112, four claws 831 held by pressing body 83 disposed above operation part 1 are located, respectively (see FIG. 1). Pressing body 83 will be described later.

Coupling body 2 is disposed to be sandwiched by operation part 1 and rotary body 3 in the vertical direction (direction D5). Coupling body 2 is configured to couple operation part 1 and rotary body 3 and to transmit a rotary operation of operation part 1 to rotary body 3.

Coupling body 2 is disposed to be housed in storing space 17 of operation part 1. Coupling body 2 is configured with a metal plate whose thickness direction is directed in the vertical direction (direction D5). Coupling body 2 is formed in a ring shape and has an approximately circular-shaped through hole 23 in the central part in a plan view. Coupling body 2 has a circular outer peripheral edge. Coupling body 2 has the pair of first openings 21 and the pair of second openings 22.

The pair of first openings 21 are formed on a straight line along direction D1 passing through a center of coupling body 2 (through hole 23). The pair of first openings 21 are formed on one side and the other side in direction D1 with respect to the center of coupling body 2 (through hole 23). The pair of first openings 21 are through holes penetrating through coupling body 2 in the vertical direction (direction D5). The pair of first openings 21 are each formed in an approximately rectangular shape whose longitudinal direction is aligned with direction D1.

Through the pair of first openings 21, the pair of first projections 14 of operation part 1 are penetrated. This arrangement mechanically couple coupling body 2 and operation part 1 to each other. In direction D1, first openings 21 have a larger dimension than first projections 14. Therefore, operation part 1 can make a sliding movement within a range of first openings 21 relatively with respect to coupling body 2 along direction D1. In the case where operation part 1 is at the standard position, first projections 14 are located at approximately central parts in direction D1 inside respective first openings 21. Therefore, operation part 1 can make a sliding movement relatively with respect to the coupling body 2 from the standard position toward one side or the other side in direction D1.

Further, in direction D2, first openings 21 have a slightly larger dimension than first projections 14. That is, the direction of relative sliding movement of operation part 1 with respect to coupling body 2 is restricted to only direction D1 by a dimensional relation between first openings 21 and first projections 14. Therefore, when operation part 1 makes a rotational movement, first projections 14 of operation part 1 come into contact with inner peripheral surfaces of first openings 21, and coupling body 2 also rotates in accordance with the rotation of operation part 1.

In addition, first cut-and-raised pieces 24 are formed to protrude upward from edges of the pair of first openings 21. First cut-and-raised pieces 24 are formed on the edges, of each first opening 21, facing each other in direction D2. First cut-and-raised pieces 24 increase a contact area between coupling body 2 and first projections 14 of operation part 1 when coupling body 2 rotates in accordance with the rotation of operation part 1, and damage to first projections 14 can thus be reduced.

In operation part 1, on the lower surface of main body part 11, first recessed parts 15 are formed at positions opposed to first cut-and-raised pieces 24. Since upper end parts of first cut-and-raised pieces 24 are located in first recessed parts 15, interference (contact) between first cut-and-raised pieces 24 and operation part 1 is prevented or reduced. Further, first recessed parts 15 are each formed such that the longitudinal direction is aligned with direction D1. Therefore, even when operation part 1 makes a sliding movement in direction D1 with respect to coupling body 2, interference (contact) between first cut-and-raised pieces 24 of coupling body 2 and operation part 1 is prevented or reduced.

The pair of second openings 22 are formed on a straight line along direction D2 passing through the center of coupling body 2 (through hole 23). The pair of second openings 22 are formed on one side and the other side in direction D2 with respect to the center of coupling body 2 (through hole 23). The pair of second openings 22 are through holes penetrating through coupling body 2 in the vertical direction (direction D5). The pair of second openings 22 are each formed in a rectangular shape whose longitudinal direction is aligned with direction D2. Through the pair of second openings 22, a pair of second projections 35 held by rotary body 3 disposed below coupling body 2 are penetrated respectively. This arrangement mechanically couples coupling body 2 and rotary body 3 to each other. In direction D2, second openings 22 have a larger dimension than second projections 35. Therefore, coupling body 2 can make a sliding movement within a range of second openings 22 relatively with respect to rotary body 3 along direction D2.

Further, in direction D1, second openings 22 have a slightly larger dimension than second projections 35. That is, the direction of relative sliding movement of coupling body 2 with respect to rotary body 3 is restricted to only direction D2 by a dimensional relation between second openings 22 and second projections 35. Therefore, when coupling body 2 makes a rotational movement in accordance with rotation of operation part 1, second projections 35 of rotary body 3 come into contact with inner peripheral surfaces of second openings 22, and the rotary body 3 also rotates in accordance with the rotation of operation part 1 and coupling body 2.

Note that operations of coupling body 2 and rotary body 3 when operation part 1 makes a sliding movement and a rotational movement will be described in detail in the section "(3) Operation example".

In addition, second cut-and-raised pieces 25 are formed to protrude upward from edges of the pair of second openings 22. Second cut-and-raised pieces 25 are formed on the edges, of each second opening 22, facing each other in direction D1. Second cut-and-raised pieces 25 increase a contact area between coupling body 2 and second projections 35 of rotary body 3 when rotary body 3 rotates in accordance with the rotation of coupling body 2, and damage to second projections 35 can thus be reduced.

In operation part 1, on the lower surface of main body part 11, second recessed parts 16 are formed at positions opposed to second cut-and-raised pieces 25, respectively. Since upper end parts of second cut-and-raised pieces 25 are located in second recessed parts 16, interference (contact) between second cut-and-raised pieces 25 and operation part 1 is prevented or reduced. Further, second recessed parts 16 are each formed such that the longitudinal direction is aligned with direction D1. Therefore, even when operation part 1 makes a sliding movement with respect to coupling body 2 in direction D1, interference (contact) between second cut-and-raised pieces 25 of coupling body 2 and operation part 1 is prevented or reduced.

Rotary body 3 is formed in a ring shape and has a circular through hole 34 in the central part in a plan view. Rotary body 3 has an approximately circular outer peripheral edge. Rotary body 3 is disposed on the lower side of coupling body 2 in base 4 (see FIG. 1). Rotary body 3 has main body part 31, corrugated part 32, and rotary terminal part 33.

Main body part 31 is configured with a resin having electric insulation properties or other material and is formed in a cylindrical shape. As shown in FIG. 4, on an upper surface of main body part 31, the pair of second projections 35 are formed. The pair of second projections 35 are formed on a straight line along direction D2 passing through a center of main body part 31 (through hole 34). The pair of second projections 35 are formed on one side and the other side in direction D2 with respect to the center of main body part 31 (through hole 34). Second projections 35 are each formed in a cylindrical shape. The pair of second projections 35 are penetrated in the pair of second openings 22 of coupling body 2, respectively. This arrangement mechanically couples coupling body 2 and rotary body 3 to each other.

In addition, on the upper surface of main body part 31, there are formed a plurality of second bosses 311 (12 bosses in the present exemplary embodiment). The plurality of second bosses 311 are formed approximately equidistantly in a circumferential direction with respect to the center of main body part 31 (through hole 34). Each of the plurality of second bosses 311 is formed in a columnar shape. Second bosses 311 have a smaller protrusion dimension in direction D5 than second projections 35. Upper ends of second bosses 311 are located below upper ends of second projections 35. The plurality of second bosses 311 prevent or reduce contact between the upper surface of main body part 31 and a lower surface of coupling body 2. In other words, the plurality of second bosses 311 reduce a contact area between rotary body 3 and coupling body 2. This arrangement reduces friction force between rotary body 3 and coupling body 2 is reduced, and thus makes it easy for coupling body 2 to make a sliding movement in accordance with the sliding movement of operation part 1.

Corrugated part 32 is formed in a circular ring shape along an inner peripheral surface of main body part 31. Corrugated part 32 is formed such that a plurality of projecting parts 321 protruding upward and a plurality of recessed parts 322 recessed downward are alternately arranged along the circumferential direction. Above corrugated part 32, there is disposed a circular ring-shaped click spring 30 (see FIG. 1). Click spring 30 is configured with, for example, a metal plate and has elasticity in the vertical direction (direction D5). Click spring 30 is fixed to base 4 above corrugated part 32 in through hole 34 of rotary body 3 and in contact with corrugated part 32. Click spring 30 has a pair of projection parts 301 protruding toward corrugated part 32. When rotary body 3 rotates, the projecting parts of corrugated part 32 come into contact with projection parts 301 of click spring 30 and elastically deforms, so that elastically deformed click spring 30 provides click feeling by returning from the elastically deformed state. That is, corrugated part 32 held by rotary body 3 and click spring 30 fixed to base 4 constitute a click mechanism that generates click feeling when operation part 1 is rotated.

Rotary terminal part 33 is disposed on a lower surface of main body part 31 (see FIG. 5). Rotary terminal part 33 is configured with a metal plate and is formed together with main body part 31 by insertion molding. Rotary terminal part 33 is formed in a circular ring shape along an outer peripheral edge of the lower surface of main body part 31. On outer periphery 331 of rotary terminal part 33, there are equidistantly formed a plurality of rectangular openings 333 along the circumferential direction. That is, on outer periphery 331 of rotary terminal part 33, conductive parts and non-conductive parts (main body part 31) are alternately arranged in the circumferential direction. Inner periphery 332 of rotary terminal part 33 is configured of a conductive part only.

Next, base 4 will be described with reference to FIGS. 1, 6, and 7. Base 4 has main body part 41 and a plurality of fixed electrodes 5.

Main body part 41 is formed in a bottomed cylinder shape and houses rotary body 3, click spring 30, rocking body 6, and return spring 60. Main body part 41 has outer separation wall 43 and inner separation wall 44.

Outer separation wall 43 is formed to protrude upward from a bottom surface of main body part 41. Outer separation wall 43 is formed on a circumference centering a central part of the bottom surface of main body part 41. In the present exemplary embodiment, outer separation wall 43 is configured with a plurality (four) of outer protruding walls 431 protruding from the bottom surface of main body part 41. The plurality of outer protruding walls 431 are separated in the circumferential direction. Two outer protruding walls 431, of the plurality of outer protruding walls 431, opposed in direction D2 each have claw 432 to fix click spring 30. Between peripheral wall 42 of main body part 41 and outer separation wall 43, rotary body 3 is disposed.

Inner separation wall 44 is formed to protrude upward from the bottom surface of the main body part. Inner separation wall 44 is formed on a circumference centering the central part of the bottom surface of main body part 41. Inner separation wall 44 is formed inside outer separation wall 43. In the present exemplary embodiment, inner separation wall 44 is configured with a plurality (eight) of inner protruding walls 441 protruding from the bottom surface of main body part 41. The plurality of inner protruding walls 441 are separated in the circumferential direction. Between outer separation wall 43 and inner separation wall 44, rocking body 6 and return spring 60 are disposed. Inside inner separation wall 44, movable contact 81 and elastic body 82 are disposed.

Figure 6:
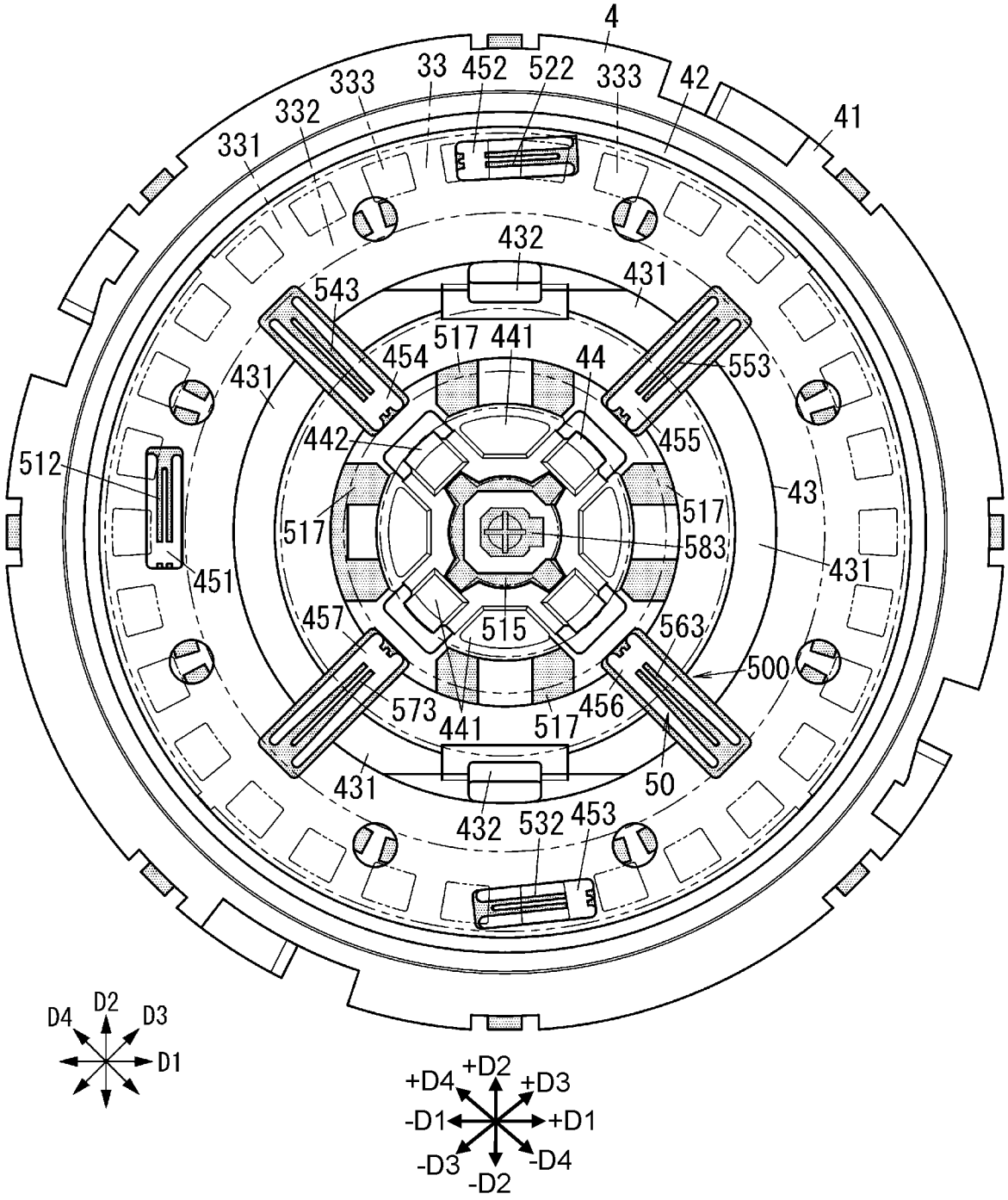
FIG. 6 is a plan view of a base of the input device shown in FIG. 1.

Each of the plurality of fixed electrodes 5 is configured with a metal plate and is formed together with main body part 41 by insertion molding (see FIGS. 2C and 6). A part of each of plurality of fixed electrodes 5 is exposed upward from the bottom surface of main body part 41. In FIG. 6, the plurality of fixed electrodes 5 are hatched with dots. The plurality of fixed electrodes 5 are each identified, being referred to as reference electrode 51, first rotation detecting electrode 52, second rotation detecting electrode 53, first slide detecting electrode 54, second slide detecting electrode 55, third slide detecting electrode 56, fourth slide detecting electrode 57, and push detecting electrode 58. The plurality of fixed electrodes 5 are disposed on a circumference centering the central part of the bottom surface of main body part 41. In the present exemplary embodiment, as shown in FIG. 7, in a plan view of the plurality of fixed electrodes 5, the electrodes are disposed in a clockwise direction in the order of reference electrode 51, first slide detecting electrode 54, first rotation detecting electrode 52, second slide detecting electrode 55, push detecting electrode 58, third slide detecting electrode 56, second rotation detecting electrode 53, and fourth slide detecting electrode 57. Reference electrode 51 is disposed in direction −D1 (left side of FIGS. 6 and 7) with respect to the central part of the bottom surface of main body part 41.

Reference electrode 51 has electrode main body 511, reference contact part 512, and protruding piece 514.

Electrode main body 511 is formed in an approximately trapezoidal shape. Electrode main body 511 is exposed on a lower side of main body part 41 and is opposed to a corresponding sensor electrode of the plurality of sensor electrodes provided on touch panel 200.

Reference contact part 512 has a pair of contact pieces 513. The pair of contact pieces 513 are formed by cutting and raising a part of electrode main body 511. The pair of contact pieces 513 are each formed such that the longitudinal direction is aligned with direction D2. The pair of contact pieces 513 have elasticity in the vertical direction. Tip parts of the pair of contact pieces 513 protrude above the bottom surface of main body part 41 through rectangular-shaped opening 451 formed, in main body part 41, between peripheral wall 42 and outer separation wall 43. The pair of contact pieces 513 are in contact with inner periphery 332 of rotary terminal part 33 held by rotary body 3. Inner periphery 332 of rotary terminal part 33 is made of only conductor. Therefore, the pair of contact pieces 513 are in contact with rotary terminal part 33 regardless of a rotation angle of rotary body 3. In other words, regardless of the rotation angle of rotary body 3, reference electrode 51 and rotary terminal part 33 of rotary body 3 are electrically connected to each other.

Figure 7:
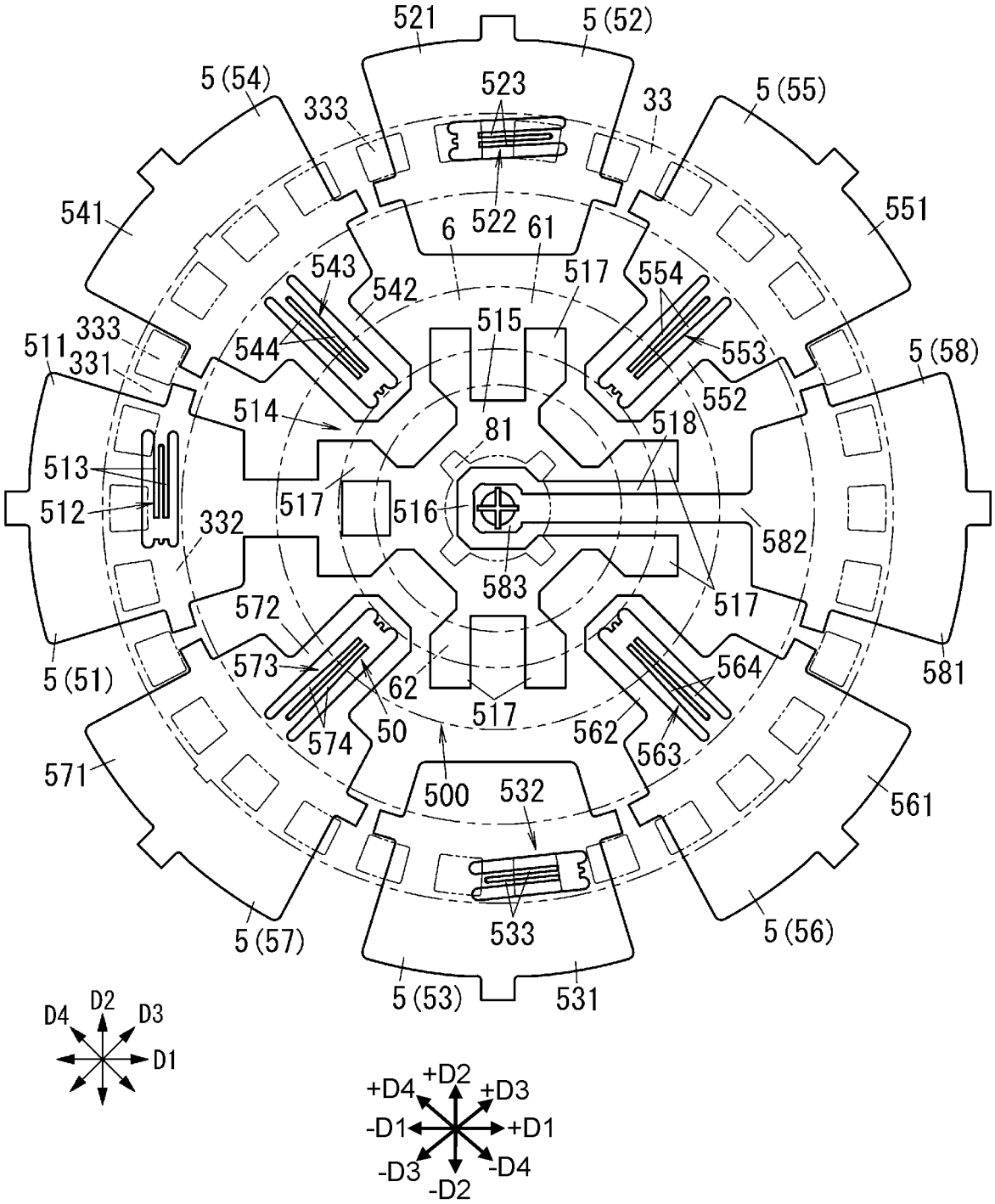
FIG. 7 is a plan view of a plurality of fixed electrodes of the input device shown in FIG. 1.

As shown in FIG. 7, protruding piece 514 protrudes from electrode main body 511 toward a central part of main body part 41. Protruding piece 514 is located above electrode main body 511 by bending, and a part of protruding piece 514 is exposed upward from the bottom surface of main body part 41. Protruding piece 514 has first contact part 515 and second contact parts 517. First contact part 515 is exposed from a part, inside inner separation wall 44, of bottom surface of main body part 41. First contact part 515 has first opening 516 formed at a central part of first contact part 515. Above first contact part 515, movable contact 81 is disposed to bridge over first opening 516. This arrangement electrically connects reference electrode 51 and movable contact 81 to each other. Second contact parts 517 are formed to protrude from first contact part 515 to both sides in direction D1 and to both sides in direction D2 and are exposed between inner separation wall 44 and outer separation wall 43 on the bottom surface of main body part 41. In second contact part 517 protruding on an end part, of first contact part 515, opposite side of electrode main body 511, there is second opening 518 formed along direction D1. On each of second contact parts 517, return spring 60 is disposed. This arrangement electrically connects reference electrode 51 and return spring 60 to each other.

First rotation detecting electrode 52 has electrode main body 521 and rotation detecting contact part 522.

Electrode main body 521 is formed in an approximately trapezoidal shape. Electrode main body 521 is exposed on the lower side of main body part 41 and is opposed to a corresponding sensor electrode of the plurality of sensor electrodes provided on touch panel 200.

Rotation detecting contact part 522 has a pair of contact pieces 523. The pair of contact pieces 523 are formed by cutting and raising a part of electrode main body 521. The pair of contact pieces 523 are each formed such that the longitudinal direction is aligned with direction D1. The pair of contact pieces 523 have elasticity in the vertical direction. Tip parts of the pair of contact pieces 523 protrude above the bottom surface of main body part 41 through rectangular-shaped opening 452 formed, in main body part 41, between peripheral wall 42 and outer separation wall 43. The pair of contact pieces 523 are in contact with outer periphery 331 of rotary terminal part 33 held by rotary body 3. Therefore, the pair of contact pieces 523 come into contact with any one of rotary terminal part 33 and main body part 31 of rotary body 3 through one of openings 333 of rotary terminal part 33 depending on the rotation angle of rotary body 3. In other words, depending on the rotation angle of rotary body 3, first rotation detecting electrode 52 and rotary terminal part 33 of rotary body 3 are electrically connected to each other.

Second rotation detecting electrode 53 has electrode main body 531 and rotation detecting contact part 532.

Electrode main body 531 is formed in an approximately trapezoidal shape. Electrode main body 531 is exposed on the lower side of main body part 41 and is opposed to a corresponding sensor electrode of the plurality of sensor electrodes provided on touch panel 200.

Rotation detecting contact part 532 has a pair of contact pieces 533. The pair of contact pieces 533 are formed by cutting and raising a part of electrode main body 531. The pair of contact pieces 533 are each formed such that the longitudinal direction is aligned with direction D1. The pair of contact pieces 533 have elasticity in the vertical direction. Tip parts of the pair of contact pieces 533 protrude above the bottom surface of main body part 41 through rectangular-shaped opening 453 formed, in main body part 41, between peripheral wall 42 and outer separation wall 43. The pair of contact pieces 533 are in contact with outer periphery 331 of rotary terminal part 33 held by rotary body 3. Therefore, the pair of contact pieces 533 come into contact with any one of rotary terminal part 33 and main body part 31 of rotary body 3 through one of openings 333 of rotary terminal part 33 depending on the rotation angle of rotary body 3. In other words, depending on the rotation angle of rotary body 3, second rotation detecting electrode 53 and rotary terminal part 33 of rotary body 3 are electrically connected to each other.

First slide detecting electrode 54 has electrode main body 541 and slide detecting contact part 543.

Electrode main body 541 is formed in an approximately trapezoidal shape. Electrode main body 541 is exposed on the lower side of main body part 41 and is opposed to a corresponding sensor electrode of the plurality of sensor electrodes provided on touch panel 200. Further, electrode main body 541 has protruding piece 542 protruding toward the central part of the bottom surface of main body part 41.

Slide detecting contact part 543 has a pair of contact pieces 544. The pair of contact pieces 544 are formed by cutting and raising a part of each of electrode main body 541 and protruding piece 542. The pair of contact pieces 544 are each formed such that the longitudinal direction is aligned with direction D4. The pair of contact pieces 544 have elasticity in the vertical direction. Tip parts of the pair of contact pieces 544 protrude above the bottom surface of main body part 41 through rectangular-shaped opening 454 formed, in main body part 41, to include a region between two outer protruding walls 431 of outer separation wall 43. Tip parts of the pair of contact pieces 544 are located between outer separation wall 43 and inner separation wall 44. The pair of contact pieces 544 come into contact with rocking body 6, depending on the direction in which rocking body 6 is inclined. Although a detailed description will be given in the section "(3) Operation example" to be described later, rocking body 6 is configured to be inclined when operation part 1 makes a sliding movement. Further, rocking body 6 is electrically connected to second contact parts 517 (reference electrode 51) through return spring 60. Therefore, depending on the slide direction of operation part 1, first slide detecting electrode 54 and reference electrode 51 are electrically connected to each other through return spring 60 and rocking body 6.

Second slide detecting electrode 55 has electrode main body 551 and slide detecting contact part 553.

Electrode main body 551 is formed in an approximately trapezoidal shape. Electrode main body 551 is exposed on the lower side of main body part 41 and is opposed to a corresponding sensor electrode of the plurality of sensor electrodes provided on touch panel 200. Further, electrode main body 551 has protruding piece 552 protruding toward the central part of the bottom surface of main body part 41.

Slide detecting contact part 553 has a pair of contact pieces 554. The pair of contact pieces 554 are formed by cutting and raising a part of each of electrode main body 551 and protruding piece 552. The pair of contact pieces 554 are each formed such that the longitudinal direction is aligned with direction D3. The pair of contact pieces 554 have elasticity in the vertical direction. Tip parts of the pair of contact pieces 554 protrude above the bottom surface of main body part 41 through rectangular-shaped opening 455 formed, in main body part 41, to include a region between two outer protruding walls 431 of outer separation wall 43. Tip parts of the pair of contact pieces 554 are located between outer separation wall 43 and inner separation wall 44. The pair of contact pieces 554 come into contact with rocking body 6, depending on the direction in which rocking body 6 is inclined. Therefore, depending on the slide direction of operation part 1, second slide detecting electrode 55 and reference electrode 51 are electrically connected to each other through return spring 60 and rocking body 6.

Third slide detecting electrode 56 has electrode main body 561 and slide detecting contact part 563.

Electrode main body 561 is formed in an approximately trapezoidal shape. Electrode main body 561 is exposed on the lower side of main body part 41 and is opposed to a corresponding sensor electrode of the plurality of sensor electrodes provided on touch panel 200. Further, electrode main body 561 has protruding piece 562 protruding toward the central part of the bottom surface of main body part 41.

Slide detecting contact part 563 has a pair of contact pieces 564. The pair of contact pieces 564 are formed by cutting and raising a part of each of electrode main body 561 and protruding piece 562. The pair of contact pieces 564 are each formed such that the longitudinal direction is aligned with direction D4. The pair of contact pieces 564 have elasticity in the vertical direction. Tip parts of the pair of contact pieces 564 protrude above the bottom surface of main body part 41 through rectangular-shaped opening 456 formed, in main body part 41, to include a region between two outer protruding walls 431 of outer separation wall 43. Tip parts of the pair of contact pieces 564 are located between outer separation wall 43 and inner separation wall 44. The pair of contact pieces 564 come into contact with rocking body 6, depending on the direction in which rocking body 6 is inclined. Therefore, depending on the slide direction of operation part 1, third slide detecting electrode 56 and reference electrode 51 are electrically connected to each other through return spring 60 and rocking body 6.

Fourth slide detecting electrode 57 has electrode main body 571 and slide detecting contact part 573.

Electrode main body 571 is formed in an approximately trapezoidal shape. Electrode main body 571 is exposed on the lower side of main body part 41 and is opposed to a corresponding sensor electrode of the plurality of sensor electrodes provided on touch panel 200. Further, electrode main body 571 has protruding piece 572 protruding toward the central part of the bottom surface of main body part 41.

Slide detecting contact part 573 has a pair of contact pieces 574. The pair of contact pieces 574 are formed by cutting and raising a part of each of electrode main body 571 and protruding piece 572. The pair of contact pieces 574 are each formed such that the longitudinal direction is aligned with direction D3. The pair of contact pieces 574 have elasticity in the vertical direction. Tip parts of the pair of contact pieces 574 protrude above the bottom surface of main body part 41 through rectangular-shaped opening 457 formed, in main body part 41, to include a region between two outer protruding walls 431 of outer separation wall 43. Tip parts of the pair of contact pieces 574 are located between outer separation wall 43 and inner separation wall 44. The pair of contact pieces 574 come into contact with rocking body 6, depending on the direction in which rocking body 6 is inclined. Therefore, depending on the slide direction of operation part 1, fourth slide detecting electrode 57 and reference electrode 51 are electrically connected to each other through return spring 60 and rocking body 6.

Push detecting electrode 58 has electrode main body 581 and protruding piece 582.

Electrode main body 581 is formed in an approximately trapezoidal shape. Electrode main body 581 is exposed on the lower side of main body part 41 and is opposed to a corresponding sensor electrode of the plurality of sensor electrodes provided on touch panel 200.

As shown in FIG. 7, protruding piece 582 protrudes from electrode main body 581 toward the central part of main body part 41. Protruding piece 582 is formed to pass through second opening 518 in second contact part 517 on protruding piece 514 of reference electrode 51. Tip part 583 of protruding piece 582 is located inside first opening 516 formed at the central part of first contact part 515 on protruding piece 514 of reference electrode 51. Tip part 583 is located above electrode main body 581 by bending and is exposed upward from the inside of inner separation wall 44 on the bottom surface of main body part 41. Tip part 583 is opposed in the vertical direction to movable contact 81 that is disposed on first contact part 515 to bridge over first opening 516. Although a detailed description will be given later, movable contact 81 is formed in a dome shape being convex upward and is configured such that, when pressing body 83 is pressed, movable contact 81 is deformed to be recessed downward. Therefore, when pressing body 83 is pressed, push detecting electrode 58 and reference electrode 51 are electrically connected to each other through movable contact 81.

Figure 8:
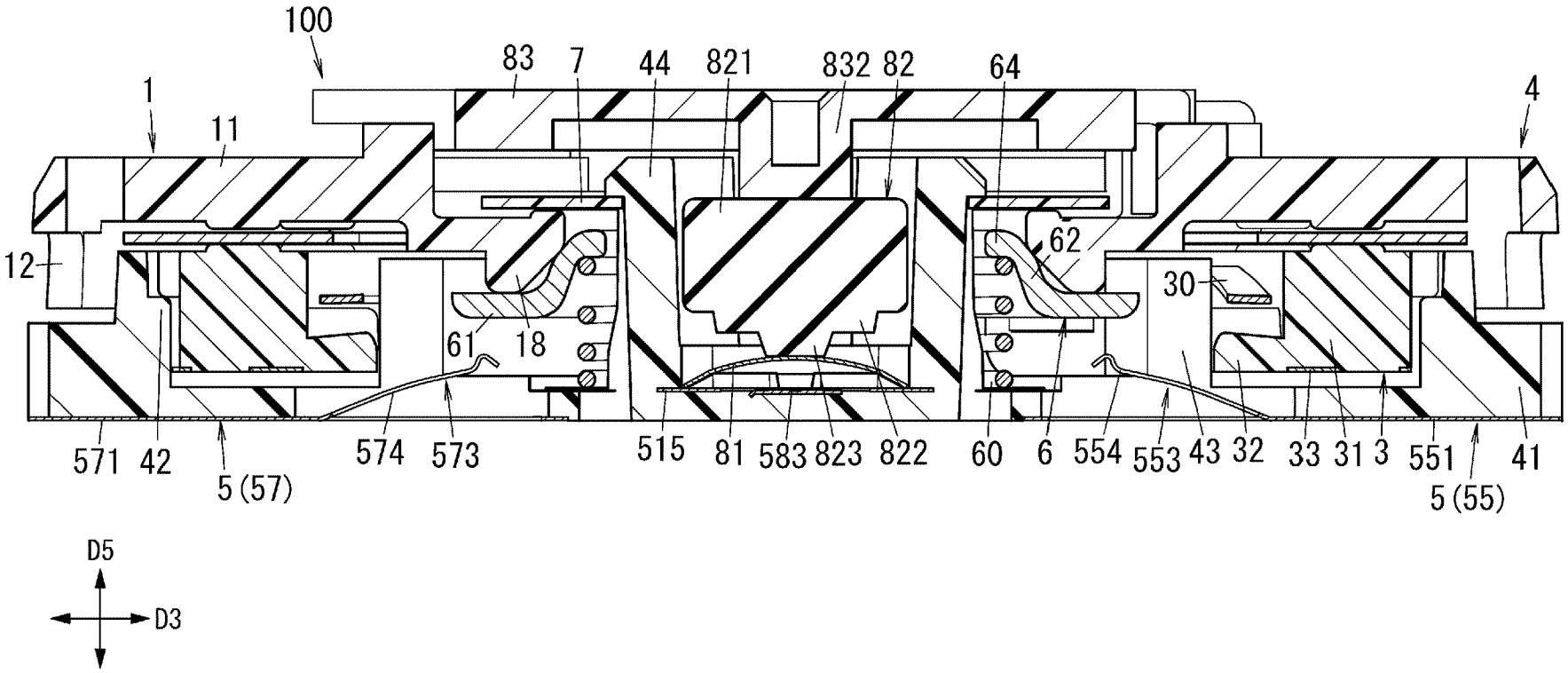
FIG. 8 is a cross-sectional view of the input device shown in FIG. 1.

Next, rocking body 6 and return spring 60 will be described with reference to FIGS. 1 and 8.

Rocking body 6 is made of metal or other material having conductivity and is formed in a ring shape. Rocking body 6 has contact part 61 and inner rib 62.

Contact part 61 is formed in a circular disc shape having a circular through hole 63 at the central part. Inner rib 62 is formed to protrude upward from an entire periphery of through hole 63. In other words, inner rib 62 is formed in a ring shape. Inner rib 62 is inclined such that a distance from inner rib 62 to a center of through hole 63 becomes smaller upward. Further, inner rib 62 has flange 64 protruding from an entire periphery of an upper end part of inner rib 62 toward the center of through hole 63.

Rocking body 6 is disposed to be in contact with outer rib 18 of operation part 1. Specifically, as shown in FIG. 8, rocking body 6 is disposed such that an upper surface of contact part 61 is in contact with a lower surface of outer rib 18 and that an outer peripheral surface of inner rib 62 is in contact with an inner peripheral surface of outer rib 18. That is, inner rib 62 of rocking body 6 is located inside outer rib 18 of operation part 1. Although a detailed description will be given in the section "(3) Operation example" to be described later, the sliding movement of operation part 1 makes rocking body 6 inclined (rocking motion), so that rocking body 6 comes into contact with one or two of slide detecting contact parts 543, 553, 563, 573.

Return spring 60 is a coil spring made of metal. Return spring 60 is disposed inside through hole 63 of rocking body 6. Specifically, return spring 60 has elasticity in the vertical direction and is disposed to be in contact with a lower surface of flange 64 of rocking body 6. Further, return spring 60 is housed between inner separation wall 44 and outer separation wall 43 on base 4. In other words, return spring 60 is disposed to pass through inner separation wall 44. Return spring 60 is disposed on second contact parts 517, of reference electrode 51, exposed from the bottom surface of main body part 41 on base 4. With this arrangement, rocking body 6 and reference electrode 51 are in electric contact with each other through return spring 60.

Return spring 60 is housed in base 4 while being compressed between rocking body 6 and second contact parts 517. Specifically, since ring-shaped fixing member 7 restricts upward movement of operation part 1, return spring 60 is housed in base 4 while being compressed. Fixing member 7 is made of, for example, metal and is formed in a circular disc shape having opening 71 at the central part. Through opening 71 of fixing member 7, inner separation wall 44 on the main body of base 4 is located. As shown in FIG. 6, four inner protruding walls 441 of the plurality of inner protruding walls 441 on inner separation wall 44 each have claw 442. Fixing member 7 is attached to base 4 with an edge of opening 71 latched by claws 442. Fixing member 7 attached to base 4 restricts upward movement of operation part 1 and rocking body 6, so that return spring 60 is housed in base 4 while being compressed (elastic deformation).

Next, movable contact 81, elastic body 82, and pressing body 83 will be described.

Movable contact 81 is made of metal or other material having conductivity. Movable contact 81 is formed in a dome shape to be convex upward and has elasticity in the vertical direction. Movable contact 81 is disposed inside inner separation wall 44 on base 4. Movable contact 81 is disposed on first contact part 515 to bridge over first opening 516. With this arrangement, movable contact 81 is electrically connected to reference electrode 51.

Elastic body 82 is made of, for example, hard rubber or other material. Elastic body 82 is disposed to be in contact with an upper surface of movable contact 81 inside inner separation wall 44 of base 4. As shown in FIG. 8, elastic body 82 has main body part 821, projection 822, and contact part 823. Main body part 821 is formed in a columnar shape. Projection 822 protrudes from a lower surface of main body part 821 and is formed in a columnar shape. Contact part 823 protrudes from a lower surface of projection 822 and is formed in a truncated cone shape. Elastic body 82 is disposed such that a lower surface of contact part 823 is in contact with the upper surface of movable contact 81.

Pressing body 83 is attached to operation part 1 in a vertically movable manner. Pressing body 83 is formed in a flat plate shape and has four claws 831 protruding downward from the both end parts of pressing body 83 in each of direction D3 and direction D4. Four claws 831 are latched on an edge of through hole 13 on a lower surface of operation part 1, passing through four through holes 112 formed in a surrounding area of through hole 13 of operation part 1. In this manner, pressing body 83 is attached to operation part 1 in a vertically movable manner. In addition, pressing body 83 has contact part 832 protruding from a lower surface of pressing body 83 (see FIG. 8). Contact part 832 is formed in a columnar shape, and a lower surface of contact part 832 is in contact with an upper surface of elastic body 82.

Note that in the present exemplary embodiment, although not shown in the drawing, a decorative knob is attached to operation part 1 to cover operation part 1. Further, pressing body 83 is attached with a decorative plate to cover pressing body 83.

(3) Operation Example

Next, an operation example of input device 100 of the present exemplary embodiment will be described.

(3.1) Slide Operation Input

A description will be given to an operation of input device 100 when a user performs slide operation input. First, with reference to FIGS. 4 and 5, a description will be given to operations of operation part 1, coupling body 2, and rotary body 3 when the slide operation input is performed.

As shown in FIGS. 4 and 5, coupling body 2 couples operation part 1 and rotary body 3 to each other while being sandwiched between operation part 1 and rotary body 3. By the pair of first projections 14 of operation part 1 being penetrated through the pair of first openings 21 of coupling body 2, operation part 1 and coupling body 2 are coupled to each other. By the pair of second projections 35 of rotary body 3 being penetrated through a pair of second openings 22 of coupling body 2, rotary body 3 and coupling body 2 are coupled to each other.

Further, the pair of first openings 21 of coupling body 2 are each formed such that the longitudinal direction is aligned with direction D1. In other words, first openings 21 extend in direction D1. Therefore, when operation part 1 is slidingly moved along direction D1, the pair of first projections 14 move in the pair of first openings 21. That is, when operation part 1 makes a sliding movement along direction D1, coupling body 2 does not move, but operation part 1 moves relatively to coupling body 2.

Further, the pair of second openings 22 of coupling body 2 are each formed such that the longitudinal direction is aligned with direction D2. In other words, second openings 22 extend in direction D2. With this arrangement, coupling body 2 can move along direction D2 within a range of second openings 22 relatively with respect to rotary body 3. Therefore, when operation part 1 is slidingly moved along direction D2, coupling body 2 moves together with operation part 1 within a range of second openings 22. When operation part 1 makes a sliding movement along direction D2, rotary body 3 does not move, but operation part 1 and coupling body 2 move relatively to rotary body 3.

Alternatively, when operation part 1 makes a sliding movement in a direction intersecting direction D1 and direction D2 (for example, direction D3 and direction D4), operation part 1 moves relatively to coupling body 2, and coupling body 2 moves relatively to rotary body 3.

That is, by coupling body 2 moving depending on the slide direction of operation part 1, operation part 1 can be slidingly moved in any direction while rotary body 3 is being fixed.

Figure 9:
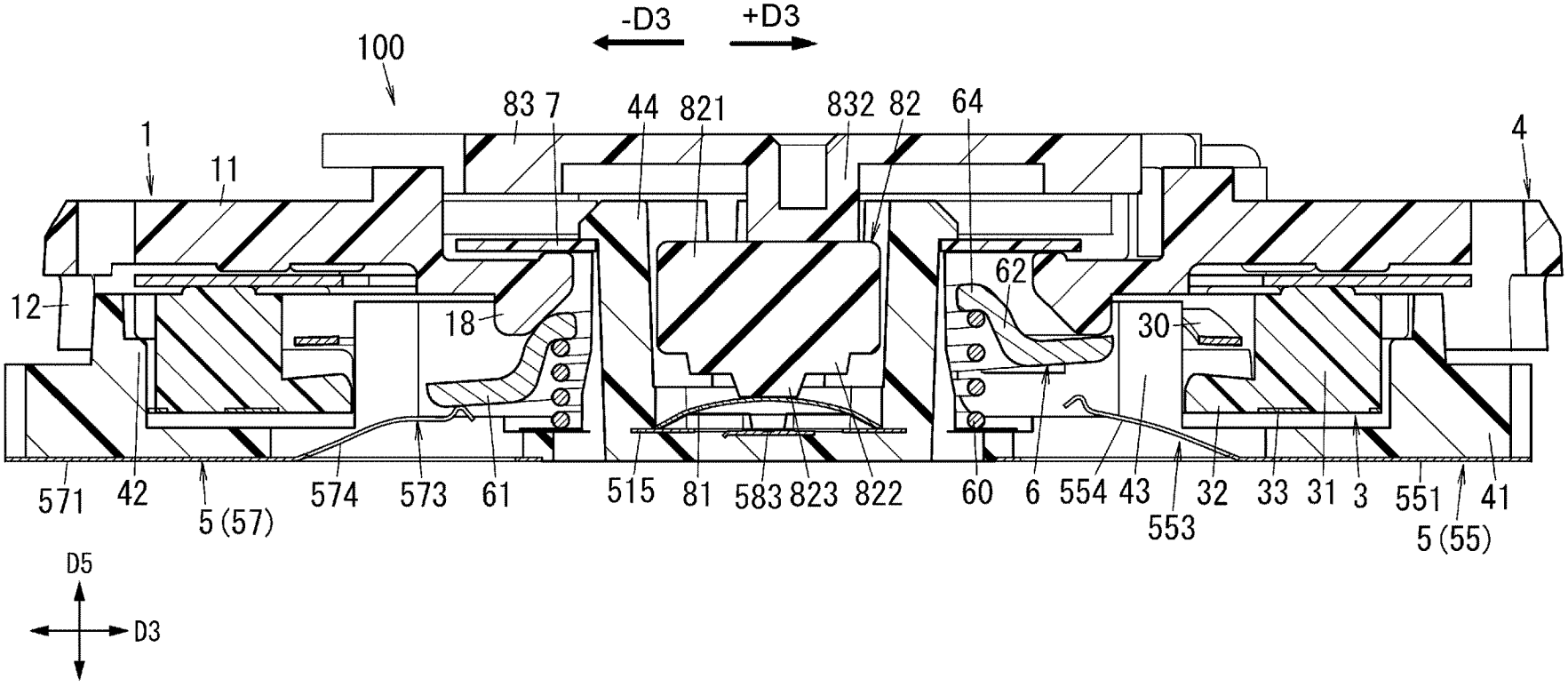
FIG. 9 is a cross-sectional view of the input device when the operation part shown in FIG. 1 has made a sliding movement.

Next, with reference to FIGS. 8 and 9, a description will be given to an operation of rocking body 6 when operation part 1 makes a sliding movement. FIG. 8 is a cross-sectional view of input device 100 along direction D3 and direction D5 when operation part 1 is at the standard position. FIG. 9 is a cross-sectional view of input device 100 when operation part 1 makes a sliding movement in direction+D3.

That is, in the present disclosure, each of directions D1 to D5 includes two directions. For example, in FIG. 9, direction D3 includes two directions of a direction to the right and a direction to the left. Note that, in the example of direction D3, the two directions are sometimes described individually such that the direction to the right is referred to as "direction +D3" and that the direction to the left is referred to as "direction −D3". Directions D1, D2, D4, and D5 other than direction D3 are sometimes described in the same manner.

Rocking body 6 is housed in base 4 such that return spring 60 makes outer rib 18 of operation part 1 and rocking body 6 be in contact with each other.

When operation part 1 makes a sliding movement, outer rib 18 of operation part 1 slides on inner rib 62 of rocking body 6. As shown in FIG. 9, this motion makes rocking body 6 is inclined such that an end part on the opposite side of a sliding movement direction (direction +D3) of operation part 1 is pressed down by operation part 1.

On a lower side of contact part 61 of rocking body 6, there are disposed slide detecting contact parts 543, 553, 563, 573 to protrude from the bottom surface of main body part 41 of base 4 (see FIG. 6). Slide detecting contact parts 543, 553, 563, 573 are equidistantly (interval of 90°) disposed on a circumference centering the central part of the bottom surface of main body part 41. By an end part of contact part 61 of rocking body 6 being pressed down to be inclined, one or two of slide detecting contact parts 543, 553, 563, 573 come into contact with rocking body 6. In the example shown in FIG. 9, operation part 1 makes a sliding movement in direction +D3 (rightward in FIG. 9), so that one of the two end parts (the end part on the left side in FIG. 9), of rocking body 6, along direction D3 is pressed down, whereby rocking body 6 and slide detecting contact part 573 come into contact with each other. Rocking body 6 is electrically connected to reference electrode 51 through return spring 60. Therefore, when rocking body 6 and slide detecting contact part 573 come into contact with each other, reference electrode 51 and fourth slide detecting electrode 57 are electrically connected to each other through return spring 60 and rocking body 6. Thus, on the basis of a change in capacitance between fourth slide detecting electrode 57 and a sensor electrode corresponding to fourth slide detecting electrode 57, operation detection circuit 300 (see FIG. 3) can detect that slide operation input is performed such that operation part 1 makes a sliding movement in direction +D3.

Although a detailed description is skipped in this description, when operation part 1 makes a sliding movement in direction −D3 (leftward in FIG. 9), rocking body 6 and slide detecting contact part 553 come into contact with each other. Further, when operation part 1 makes a sliding movement in direction +D1 (rightward in FIG. 6), rocking body 6 comes into contact with slide detecting contact parts 543, 573. When operation part 1 makes a sliding movement in direction −D1 (leftward in FIG. 6), rocking body 6 comes into contact with slide detecting contact parts 553, 563. When operation part 1 makes a sliding movement in direction +D2 (upward in FIG. 6), rocking body 6 comes into contact with slide detecting contact parts 563, 573. When operation part 1 makes a sliding movement in direction −D2 (downward in FIG. 6), rocking body 6 comes into contact with slide detecting contact parts 543, 553. When operation part 1 makes a sliding movement in direction +D4 (left upward in FIG. 6), rocking body 6 comes into contact with slide detecting contact part 563. When operation part 1 makes a sliding movement in direction −D4 (right downward in FIG. 6), rocking body 6 comes into contact with slide detecting contact part 543. With the above operations, on the basis of a change in capacitance between each of first to fourth slide detecting electrodes 54 to 57 and the sensor electrode, operation detection circuit 300 can detect in which direction of the eight directions along respective directions +D1 to +D4 and −D1 to −D4 operation part 1 makes a sliding movement due to slide operation input.

As described above, in input device 100 of the present exemplary embodiment, rocking body 6 and slide detecting contact parts 543, 553, 563, 573 (rocking motion detector 50) have a function as slide detector 500 that detects the sliding movement of operation part 1 (see FIGS. 6 and 7). In other words, slide detector 500 has rocking body 6 and rocking motion detector 50, which is slide detecting contact parts 543, 553, 563, 573. Rocking motion detector 50 (slide detecting contact parts 543, 553, 563, 573) detects the inclination of rocking body 6 by coming into contact with rocking body 6 to make electric contact. Further, rocking motion detector 50 has: a first detector that detects inclination of rocking body 6 in accordance with the sliding movement of operation part 1 in direction D1; and a second detector that detects inclination of rocking body 6 in accordance with the sliding movement of operation part 1 in direction D2. In the present exemplary embodiment, slide detecting contact parts 543, 553, 563, 573 are disposed on a straight line along direction D3 or direction D4, which intersect direction D1 and direction D2. That is, each of slide detecting contact parts 543, 553, 563, 573 doubles as the first detector and the second detector.

Further, rocking body 6 is held to be pressed against operation part 1 by return spring 60. Therefore, when slide operation input is released, rocking body 6 returns back to an initial state from an inclined state by elastic force of return spring 60. Thus, operation part 1 is pushed back, by rocking body 6, to the standard position from the position to which operation part 1 has made a sliding movement. That is, rocking body 6 has a function of a return cam that returns operation part 1 having made a sliding movement, back to the standard position.

(3.2) Rotational Operation Input

Next, a description will be given to the operation of input device 100 when a user performs rotational operation input.

As shown in FIGS. 4 and 5, coupling body 2 couples operation part 1 and rotary body 3 to each other while being sandwiched between operation part 1 and rotary body 3. By the pair of first projections 14 of operation part 1 being penetrated through the pair of first openings 21 of coupling body 2, operation part 1 and coupling body 2 are coupled to each other. By the pair of second projections 35 of rotary body 3 being penetrated through the pair of second openings 22 of coupling body 2, rotary body 3 and coupling body 2 are coupled to each other.

In a circumferential direction of coupling body 2, outer peripheral surfaces of the pair of first projections 14 and the inner peripheral surfaces of first openings 21 are in contact with each other, or there are slight gaps between the outer peripheral surfaces of the pair of first projections 14 and the inner peripheral surfaces of the pair of first openings 21. Further, in the circumferential direction of coupling body 2, outer peripheral surfaces of the pair of second projections 35 and the inner peripheral surfaces of second openings 22 are in contact with each other, or there are slight gaps between the outer peripheral surfaces of the pair of second projections 35 and the inner peripheral surfaces of second openings 22. Therefore, when operation part 1 makes a rotational movement, the pair of first projections 14 come into contact with the inner peripheral surfaces of the pair of first openings 21, so that coupling body 2 rotates. When coupling body 2 rotates, the pair of second projections 35 come into contact with the inner peripheral surfaces of the pair of second openings 22, so that rotary body 3 rotates. That is, coupling body 2 transmits the rotary operation of operation part 1 to rotary body 3, and rotary body 3 rotates in accordance with the rotation of operation part 1.

On the lower surface of main body part 31 of rotary body 3, rotary terminal part 33 is provided (see FIG. 5). On a lower side of rotary terminal part 33, reference contact part 512 and rotation detecting contact parts 522, 532 are disposed to protrude from the bottom surface of main body part 41 of base 4 (see FIG. 6).

Reference contact part 512 is in contact with inner periphery 332 of rotary terminal part 33 (see FIG. 5). Therefore, reference contact part 512 (see FIG. 6) is in contact with rotary terminal part 33 regardless of a rotation angle of rotary body 3 (see FIG. 5). Further, rotation detecting contact parts 522, 532 are in contact with outer periphery 331 of rotary terminal part 33. Therefore, rotation detecting contact parts 522, 532 come into contact with any one of rotary terminal part 33 and main body part 31 of rotary body 3 through one of openings 333 of rotary terminal part 33 depending on the rotation angle of rotary body 3.

That is, depending on the rotation angle of rotary body 3, reference electrode 51 and first rotation detecting electrode 52 come into electric contact with each other through rotary terminal part 33. Further, depending on the rotation angle of rotary body 3, reference electrode 51 and second rotation detecting electrode 53 come into electric contact with each other through rotary terminal part 33.

Rotation detecting contact parts 522, 532 are disposed such that there is a difference between the rotation angle of rotary body 3 at which reference electrode 51 and first rotation detecting electrode 52 are in contact with each other and the rotation angle of rotary body 3 at which reference electrode 51 and second rotation detecting electrode 53 are in electric contact with each other. With this arrangement, on the basis of a change in the capacitance between each of first rotation detecting electrode 52 and second rotation detecting electrode 53 and the sensor electrode, operation detection circuit 300 (see FIG. 3) can detect a rotation angle and a rotation direction of the rotational operation input in operation part 1 (rotary body 3).

(3.3) Push Operation Input

Next, a description will be given to the operation of input device 100 when a user performs push operation input.

When pressing body 83 is pressed by push operation input (see FIG. 3), movable contact 81 is pressed via elastic body 82, and movable contact 81 is elastically deformed to be recessed. Movable contact 81 is disposed on first contact part 515 to bridge over first opening 516 (see FIG. 7) and is electrically connected to reference electrode 51. Further, in first opening 516 there is located tip part 583 of push detecting electrode 58 (see FIG. 7). Therefore, when pressing body 83 is pressed and movable contact 81 is thus deformed to be recessed, movable contact 81 comes into contact with tip part 583. This brings reference electrode 51 and push detecting electrode 58 into electric contact with each other. On the basis of the change in the capacitance between push detecting electrode 58 and the sensor electrode, operation detection circuit 300 (see FIG. 3) can detect that push operation input is performed.

(4) Modified Examples

In the following, modified examples of input device 100 of the present exemplary embodiment will be recited.

In the present exemplary embodiment, as shown in FIGS. 4 and 5, coupling body 2 includes two first openings 21 and two second openings 22, without being limited to this configuration. Coupling body 2 may be configured to include one first opening 21 or more than two first openings 21. Further, coupling body 2 may be configured to include one second opening 22 or more than two second openings 22.

As shown in FIGS. 4 and 5, first openings 21 and second opening 22 of coupling body 2 are each constituted by a through hole, without being limited to this configuration. First openings 21 and second openings 22 may be bottomed holes (grooves). Further, first openings 21 and second openings 22 may be formed to reach the inner peripheral edge or the outer peripheral edge of coupling body 2.

A fitting relationship between first projections 14 of operation part 1 and first openings 21 of coupling body 2 may be opposite. That is, coupling body 2 may have projections protruding toward operation part 1, and operation part 1 may have openings in which the projections of coupling body 2 are located. Further, a fitting relationship between second projections 35 of rotary body 3 and second openings 22 of coupling body 2 may be opposite. That is, coupling body 2 may have projections protruding toward rotary body 3, and rotary body 3 may have openings in which the projections of coupling body 2 are located.

Further, the intersecting angle between direction D1, which is the longitudinal direction of first openings 21, and direction D2, which is the longitudinal direction of second opening 22, is not limited to 90°, and directions D1 and D2 may intersect at an angle other than 90° (perpendicular).

Further, input device 100 of the present exemplary embodiment is configured to detect a sliding movement of operation part 1 along each of 8 directions +D1 to +D4 and −D1 to −D4, but a detectable slide direction is not limited to 8 directions and may be, for example, 4 directions or 16 directions.

Further, there may be provided a rotation preventing structure to prevent rocking body 6 from rotating in accordance with the rotation of operation part 1. The rotation preventing structure may be achieved, for example, by forming an outer peripheral shape of rocking body 6 and an inner peripheral shape of outer separation wall 43 in a non-circular shape.

Further, in the present exemplary embodiment, rocking motion detector 50 is slide detecting contact parts 543, 553, 563, 573 and is configured to detect the inclination of rocking body 6 by coming into contact with rocking body 6 and thus making electric contact, without being limited to this configuration. For example, rocking motion detector 50 may be configured with push switches and may detect the inclination of rocking body 6 by being pressed by rocking body 6 being inclined. Further, rocking motion detector 50 may be configured to include, for example, a Hall element to detect the inclination of rocking body 6 in a non-contact manner.

(5) Conclusion

Input device (100) according to an aspect includes: operation part (1) that can slides in first direction (D1) along a reference plane and in second direction (D2) along the reference plane; and slide detector (500) detecting that the operation part (1) slides. Slide detector (500) has rocking body (6) and rocking motion detector (50). Rocking body (6) is inclined with respect to the reference plane in accordance with the sliding movement of operation part (1). Rocking motion detector (50) detects that rocking body (6) is inclined.

With this aspect, single rocking body (6) can detect the sliding movement of operation part (1) along first direction (D1) or second direction (D2); thus, the configuration is so simplified that input device (100) can be downsized.

In input device (100) according to an aspect, rocking motion detector (50) detects that above-described rocking body (6) is inclined, by coming into contact with above-described rocking body (6).

With this aspect, it can be detected with a simple configuration that rocking body (6) is inclined.

In input device (100) according to an aspect, rocking motion detector (50) detects contact with rocking body (6) by making electric contact with rocking body (6).

In this aspect, since inclination of rocking body (6) is detected by electric conductivity between rocking motion detector (50) and rocking body (6), erroneous detection can be prevented or reduced.

In input device (100) according to an aspect, rocking body (6) comprises a return cam that returns operation part (1) being slid back to a position where operation part (1) was located before operation part (1) was slid.

According to this aspect, since rocking body (6) that is inclined in accordance with the sliding movement of operation part (1) comprises the return cam that returns operation part (1) back to the position where operation part (1) is located before operation part (1) is slid, a number of components can be reduced, so that input device (100) can be downsized.

In input device (100) according to an aspect, first direction (D1) and second direction (D2) perpendicularly intersect each other.

With this aspect, it is possible to detect the sliding movement of operation part (1) in four directions that perpendicularly intersect each other.

In input device (100) according to an aspect, rocking motion detector (50) has first detector (543, 553, 563, 573) and second detector (543, 553, 563, 573). First detector (543, 553, 563, 573) is provided on an end part of rocking body (6) in first direction (+D1) and on an end part of rocking body (6) in opposite direction (−D1) of first direction (+D1) to detect the inclination of rocking body (6) in accordance with the sliding movement of operation part (1) in first direction (+D1). Second detector (543, 553, 563, 573) is provided on an end part of rocking body (6) in second direction (+D2) and on an end part of rocking body (6) in opposite direction (−D2) of second direction (+D2) to detect the inclination of rocking body (6) in accordance with the sliding movement of operation part (1) in second direction (+D2).

With this aspect, it is possible to detect the sliding movement of operation part (1) in first direction (D1) or second direction (D2), with first detector (543, 553, 563, 573) and second detector (543, 553, 563, 573).

In input device (100) according to an aspect, operation part (1) has ring-shaped outer rib (18). Rocking body (6) has ring-shaped inner rib (62) disposed inside outer rib (18). When operation part (1) slides, outer rib (18) of operation part (1) slides on inner rib (62) of rocking body (6), so that rocking body (6) is inclined.

With this aspect, rocking body (6) can be inclined in accordance with the sliding movement of operation part (1) with a simple configuration.

REFERENCE MARKS IN THE DRAWINGS

1: operation part
2: coupling body
3: rotary body
4: base
5: fixed electrode
6: rocking body
7: fixing member
11: main body part
12: peripheral wall
13: through hole
14: first projection
15: recessed part
16: recessed part
17: storing space
18: outer rib

21: first opening
22: second opening
23: through hole
24: first cut-and-raised piece
25: second cut-and-raised piece
30: click spring
31, 41: main body part
32: corrugated part
33: rotary terminal part
34: through hole
35: second projection
42: peripheral wall
43: outer separation wall
44: inner separation wall
50: rocking motion detector
51: reference electrode
52: first rotation detecting electrode
53: second rotation detecting electrode
54: first slide detecting electrode
55: second slide detecting electrode
56: third slide detecting electrode
57: fourth slide detecting electrode
58: push detecting electrode
61: contact part
62: inner rib
63: through hole
64: flange
71: opening
81: movable contact
82: elastic body
83: pressing body
100: input device
101: holding member
111: first boss
112: through hole
200: touch panel
300: operation detection circuit
301: projection part
311: second boss
321: projecting part
322: recessed part
331: outer periphery
332: inner periphery
333, 451, 452, 453, 454, 455, 456, 457: opening
431: outer protruding wall
432, 442: claw
441: inner protruding wall
500: slide detector
511, 521, 531, 541, 551, 561, 571, 581: electrode main body
512: reference contact part
513, 523, 533, 544, 554, 564, 574: contact piece
514, 542, 552, 562, 572, 582: protruding piece
515: first contact part
516: first opening
517: second contact part
518: second opening
522, 532: rotation detecting contact part
543, 553, 563, 573: slide detecting contact part
583: tip part
821: main body part
822: projection
823, 832: contact part
831: claw
D1: direction (first direction)
D2: direction (second direction)
D3: direction
D4: direction
D5: direction

The invention claimed is:

1. An input device comprising:

an operation part being slidable in a first axis along a reference plane and in a second axis different from the first axis along the reference plane; and a slide detector configured to detect that the operation part slides, wherein:

the slide detector includes a rocking body and a rocking motion detector, the rocking body is tilted with respect to the reference plane in accordance with a sliding movement of the operation part, the rocking motion detector detects that the rocking body is tilted, the operation part has a first rib has a ring shape, the rocking body has a second rib that has a ting shape and is disposed inside the first rib, and when the operation part moves along the first axis in a direction toward a first side of the input device, a first side of the rocking body located at the first side of the input device moves upwardly and a second side of the rocking body located at a second side of the input device opposite to the first side of the input device along the first axis moves downwardly.

2. The input device according to claim 1, wherein the rocking motion detector detects that the rocking body is tilted, by coming into contact with the rocking body.

3. The input device according to claim 1, wherein the rocking motion detector detects the contact with the rocking body, by making electric contact with the rocking body.

4. The input device according to claim 1, wherein the rocking body comprises a return cam that returns the operation part slid back to a position where the operation part is located before the operation part is slid.

5. The input device according to claim 1, wherein the first axis and the second axis perpendicularly intersect each other.

* * * * *